US008118182B1

(12) United States Patent
Licari

(10) Patent No.: US 8,118,182 B1
(45) Date of Patent: Feb. 21, 2012

(54) ERGONOMIC BEVERAGE CONTAINER

(76) Inventor: Robert Licari, Huntington, NY (US)

( * ) Notice: Subject to any disclaimer, the term of this patent is extended or adjusted under 35 U.S.C. 154(b) by 532 days.

(21) Appl. No.: 11/833,118

(22) Filed: Aug. 2, 2007

(51) Int. Cl.
*A61J 9/00* (2006.01)

(52) U.S. Cl. ..... 215/11.1; 215/11.4; 215/11.5; 215/11.6; 220/717

(58) Field of Classification Search ..... 215/11.4, 215/216, 215, 201, 225, 224, 391, 261, 11.1, 215/11.5, 11.6; 220/717, 791, 789, 780
See application file for complete search history.

(56) References Cited

U.S. PATENT DOCUMENTS

| | | | | |
|---|---|---|---|---|
| 1,183,728 | A * | 5/1916 | Griffith | 215/11.1 |
| 4,305,517 | A * | 12/1981 | Dennis | 215/256 |
| 5,509,549 | A * | 4/1996 | Marandola | 215/11.3 |
| 5,875,908 | A * | 3/1999 | Witt et al. | 215/256 |
| 6,283,318 | B1 * | 9/2001 | Lee | 215/254 |
| 6,523,710 | B1 * | 2/2003 | Hidding et al. | 215/252 |
| 6,640,992 | B1 * | 11/2003 | Berger et al. | 220/603 |
| 6,708,833 | B2 * | 3/2004 | Kolb | 215/11.1 |
| 6,793,094 | B2 * | 9/2004 | Turnbough | 220/603 |
| 7,234,606 | B2 * | 6/2007 | Kraus et al. | 215/11.1 |
| 7,543,713 | B2 * | 6/2009 | Trude et al. | 215/373 |
| 7,552,831 | B2 * | 6/2009 | Catton | 215/11.1 |
| 7,556,172 | B2 * | 7/2009 | Lane | 220/714 |
| 2002/0158075 | A1 * | 10/2002 | Caldicott et al. | 220/714 |
| 2004/0026351 | A1 * | 2/2004 | Dunn et al. | 215/11.1 |

* cited by examiner

*Primary Examiner* — Jacob K Ackun
*Assistant Examiner* — Kareen Rush
(74) *Attorney, Agent, or Firm* — Michael I. Kroll

(57) ABSTRACT

A disposable or long term use beverage container having a cup portion with an aperture therein and a mating cap portion with a mouthpiece extending therefrom with one of the portions having an annular ridge and the other an annular groove for receiving said ridge therein sealing the disposable beverage container from leakage. Additionally the mouthpiece extending from the cap is designed to anatomically fit the user's mouth and provides that the mouthpiece may be nipple shaped for babies and toddlers. Also provided are nubs protruding from opposing sides of the cap that when squeezed breaks the cup cap seal allowing for removal of the cap for selective refilling as desired. The present invention also provides that the disposable beverage container may be manufactured from microwave safe material for those beverages that may require heating.

15 Claims, 10 Drawing Sheets

ERGONOMIC BEVERAGE CONTAINER

BACKGROUND OF THE INVENTION

1. Field of the Invention

The present invention relates generally to containers and, more specifically, to a beverage container having a ridged hourglass-like shape with a cup portion having an aperture therein and an aperture mating cap portion with a mouthpiece extending therefrom.

One of the portions has an annular ring and the other an annular groove for receiving said ring and therein sealing the ergonomic beverage container from leakage.

The mouthpiece extending from the cap is designed to anatomically fit the user's mouth and additionally provides that the mouthpiece may be nipple shaped for babies and toddlers.

Additionally provided are nubs protruding from opposing sides of the cap that when squeezed breaks the cup cap seal allowing for removal of the cap whereby the ergonomic container can be refilled as desired.

Furthermore, the present invention provides that the beverage container may be manufactured from microwave safe material for beverages that may require heating.

2. Description of the Prior Art

There are other containers designed for beverage storage. Typical of these is U.S. Pat. No. 2,608,841 issued to Rice on Sep. 2, 1952.

Another patent was issued to Dixon, Sr. et al. on Mar. 27, 1979 as U.S. Pat. No. 4,146,157. Yet another U.S. Pat. No. 4,946,062 was issued to Coy on Aug. 7, 1990 and still yet another was issued on Jan. 13, 1998 to Robbins, III, et al. as U.S. Pat. No. 5,706,973.

Another patent was issued to Belcastro on Apr. 6, 1999 as U.S. Pat. No. 5,890,620. Yet another U.S. Pat. No. 5,988,425 was issued to Yehl, et al. on Nov. 23, 1999. Another was issued to Connors, Jr., et al. on Mar. 6, 2007 as U.S. Pat. No. 7,185,784 and still yet another was issued on Apr. 17, 2007 to Hakim as U.S. Pat. No. 7,204,386.

Another patent was issued to Hsu on Feb. 27, 1992 as German Patent No. DE9200120. Yet another U.K. Patent No. GB2307633 was issued to McCallum-Toppin on Apr. 6, 1997. Another was issued to Iodice on May 15, 1997 as International Patent Application No. WO 97/17005 and still yet another was issued on Feb. 22, 2001 to Samson as International Patent Application No. WO 01/12031.

U.S. Pat. No. 2,608,841

Inventor: William W. Rice

Issued: Sep. 2, 1952

A drinking cup for the purposes herein set forth comprising a cup portion, a cap for said cup portion including a portion adapted to telescope frictionally into the open end of the cup, a nipple formed integral with the cap at one side thereof and providing a passage communicating with the cup, a rotatable air control valve frictionally carried by the cap at the side thereof opposite the nipple and having an opening formed therethrough adapted to be closed by the index finger of a hand supporting the cup, said valve having passages formed in its side walls and communicating with said opening, said top wall if the cap having a passage formed therein communicating with said opening of the valve through said valve passages, said telescoping portion of said cap being offset with respect to the side walls thereof to provide a shoulder limiting the insertion of said portion into said cup.

U.S. Pat. No. 4,146,157

Inventor: Lester A. Dixon

Issued: Mar. 27, 1979

A top (or lid) for an existing drinking cup which permits the insertion of a liquid into the cup without removal of the top and which also prevents the liquid from splashing or spilling from the cup during the filling or drinking operation. The top comprises means for fixing same to the cup or similar receptacle. The top includes suitable holes or apertures for permitting the passage of fluid therethough. Likewise, the top includes suitable openings or apertures for permitting the passage of air therethrough when the fluid is being inserted into the cup. A lip or rim describes the outer periphery of the top. In one embodiment, a mouth piece may be integrally formed with the lip. In another embodiment, the apertured member may be separate from the top.

U.S. Pat. No. 4,946,062

Inventor: Peter Coy

Issued: Aug. 7, 1990

A container closure lid having a valved spout is disclosed. The valve is normally closed so as to prevent spillage from the container. In use, the valve is opened by the application of force laterally to the edge of the valve. In addition, a valved spout which is particularly adapted to permit close stacking of the lids is disclosed.

U.S. Pat. No. 5,706,973

Inventor: Edward S. Robbins, III

Issued: Jan. 13, 1998

A drinking cup having a body portion and a removably attached cover including an offset drinking spout and an offset vent aperture. The drinking spout and the vent aperture are each surrounded by wall members which depend generally away from an interior surface of the cover. An air inlet flow control valve is coupled to the wall member surrounding the vent aperture while a liquid outlet flow control valve is coupled to the wall member surrounding the spout. Each flow control valve includes a domed elastomeric member containing a slit allowing for passage of a selected fluid therethrough. The domed portions are each surrounded by a generally circular isolating channel, and outside of each isolating channel is a perimetral portion for connecting the flow control valve to the depending wall portion of the cover. Fluids passing through the slits achieve substantially only a one-way passage as the domed curvature substantially prevents any backflow. Vacuum must be applied on the convex side of the domed portion for sufficient elastomeric displacement to allow a fluid to pass through the slit. In the absence of such a vacuum, the sides of the slit are maintained in contiguous contact thereby preventing any transfer of liquid or air across the respective flow control valve. Coupling means are provided for coupling the flow control valves together, and may include handle portions integrally attached to the perimetral portion and including joining means for joining the handle portions together.

U.S. Pat. No. 5,890,620

Inventor: Domenic Belcastro

Issued: Apr. 6, 1999

A self-sealing drinking container includes a cup body having a hollow interior for holding and dispensing a liquid, and a lid assembly which fits sealingly on the cup body. The lid assembly has an inlet passage with an inlet valve in communication therewith, and an outlet passage with an outlet valve in communication therewith, each of the valves including a resiliently flexible diaphragm member. In a preferred embodiment, each of the inlet and outlet valves includes a cage having an open top and an open bottom to allow fluid passage therethrough, the cage having a seat formed therein for receiving a diaphragm member. The diaphragm member is located seatably into the seat so as to selectively seal thereagainst and thereby prevent fluid flow therepast. A locator post in each cage centrally abuts the diaphragm member thereof to ensure its seating. A predetermined level of fluid pressure differential across each diaphragm member causes, respectively, the diaphragm members to concavely bend (or flex) away from their respective seat and thereby allow fluid flow through the valves. However, below the respective predetermined levels of fluid pressure differential, the diaphragm members sealingly abut their respective seats, thereby sealing the cup.

U.S. Pat. No. 5,988,425

Inventor: Gregory Yehl

Issued: Nov. 23, 1999

A sipper cup including a cup assembly having a plurality of threaded grooves formed adjacent a top opening thereof. Further provided is a cap assembly having a spout integrally formed on an upper surface thereof. The cap assembly is equipped with a plurality of threaded grooves for allowing the screwable coupling of the cap assembly with the cup assembly. Such threaded grooves of the cap assembly and the cup assembly are adapted to allow air to pass therethrough. Also included is an elastomeric insert including a spout valve for allowing fluid to exit the spout of the cap assembly only upon the application of suction. In use, air is allowed to enter the cup through the threaded grooves thus compensating for the vacuum formed in the cup assembly upon the exiting of fluid from the spout.

U.S. Pat. No. 7,185,784

Inventor: James A. Connors, Jr. et al.

Issued: Mar. 6, 2007

A disposable child's drinking cup has a lid with a drinking spout defining multiple open holes sized to resist leakage in the absence of suction, such as by the development of surface tension at the holes, and to allow flow when suction is applied. The holes are formed during molding of the lid. An inner contour of a groove of the lid and an outer contour of the cup body rim are selected to provide a slight snap fit of the lid onto the cup body, to provide a secure seal.

U.S. Pat. No. 7,204,386

Inventor: Noun E. Hakim

Issued: Apr. 17, 2007

An improved no-spill cup construction and valve assembly which provides an extremely secure seal against accidental liquid flow from the cup spout. The act of sucking at the cup spout creates negative pressure or a partial vacuum against a valve near the spout, causing the valve to invert which unblocks an opening in the valve. When the opening is unblocked, liquid can flow freely through the valve and spout. When not in use, the valve sits in a resting, closed position, with the valve pressed against a center seal-off, sealing off the opening in the valve assembly. The closed position provides an extremely secure seal against fluid leakage, such that inadvertent spills or even deliberate attempts to force liquid outside of the cup, such as by turning the cup upside down, or shaking the cup, are ineffective. The cup assembly further allows liquid flow to be regulated between regular or maximum flow and minimal flow levels or rates by rotating the position of the valve assembly in the cover of the cup.

German Patent Number DE 9200120U

Inventor: Shen-Kwang Hsu

Issued: Feb. 27, 1992

Depicted is a beverage receptacle having a lid with interchangeable caps comprising a mouthpiece cap, a nipple cap and a cap having apertures with one serving as a straw holder and the other providing access to the receptacle beverage.

U.K. Patent Number GB2307633

Inventor: Angus McCallum-Toppin

Published: Jun. 4, 1997

The sip-through lid enables cups containing beverages to be carried stacked on top of each other. This allows the fast-food take-away consumer to carry more than one cup per hand at a time without the use of a tray. The configuration of the lid allows the consumer to comfortably sip-through the lid.

International Patent Application Number WO97/17005

Inventor: Austin Iodice

Published: May 15, 1997

A liquid dispensing cup (10) for use by a toddler is disclosed having generally cylindrical upper (12) and lower (14) portions joined in fluid communication by a pair of integral tubular sections (16 and 18) or handles. The upper and lower portions and the pair of integral handles define a central opening (22) through the cup. The tubular sections (16 and 18), in connection with the central opening (22), provide readily grippable handles near the center of gravity of the cup for the toddler to grasp with one or both hands. The liquid dispensing cup has a closure (28) including an integrally molded spout (30) in fluid communication with the interior of the cup to provide for sipping of fluids contained within the cup.

International Patent Application Number WO 01/12031

Inventor: Robert P. Wharton

Issued: Feb. 22, 2001

A cup is disclosed which includes: a sealingly engageable lid (10) having a drinking spout (14) located thereon, a tubular passage (20) formed between inner surface of the lid (10) and/or spout (14) and a detachable member (18) located on the lid (10), the passage (20) having one end in communication with the inside of the cup and the other end in communication with the outside of the spout (14) and being of such a diameter such that air cannot readily bubble past liquid inside it. When such a cup is inverted, the head of liquid inside lowers the pressure of the air above the liquid, and liquid therefore starts to move downwardly through the passage. This continues until the reduction in air pressure above the liquid just balances the pressure of the liquid head, when further movement of liquid ceases. (The fact that air cannot bubble past the liquid in the passage ensures that the air pressure is not restored while the cup is inverted or reclined). Thus the capacity of the passage should be great enough to contain this amount of liquid without reaching the exit and therefore spilling.

While these receptacles may be suitable for the purposes for which they were designed, they would not be as suitable for the purposes of the present invention, as hereinafter described.

SUMMARY OF THE PRESENT INVENTION

A primary object of the present invention is to provide a disposable or long term use beverage container having a mouthpiece extending therefrom.

Another object of the present invention is to provide a disposable or long term use beverage container having a cup portion and a lockingly engagable cap portion.

Yet another object of the present invention is to provide a disposable or long term use beverage container having an annular ridge and groove providing the locking engagement elements.

Still yet another object of the present invention is to provide a disposable or long term use beverage container wherein said cap portion has opposing tabs extending therefrom whereby pressure placed thereon breaks the cap to cup bond so that the container can be refilled as desired.

An additional object of the present invention is to provide a disposable or long term use beverage container wherein said cap has a pin hole extending through the cap for pressure relief.

Another object of the present invention is to provide a disposable or long term use beverage container wherein said mouthpiece is anatomically shaped for a user's mouth.

Yet another object of the present invention is to provide a disposable or long term use beverage container wherein said mouthpiece alternately is nipple shaped for babies and toddlers.

Still yet another object of the present invention is to provide a disposable or long term use beverage container wherein the disposable beverage container is manufactured of a microwavable safe material.

Another object of the present invention is to provide a disposable or long term use beverage container that fits within the typical motor vehicle cup holder.

Yet another object of the present invention is to provide a disposable or long term use beverage container wherein said cup portion has a somewhat hourglass shape to aid in handling by small children.

Still yet another object of the present invention is to provide a disposable or long term use beverage container having a body portion with diametrically constricted portions to aid in the use by small children.

An additional object of the present invention is to optionally provide frictional material disposed on the exterior body surface as a further aid for use by the user.

Additional objects of the present invention will appear as the description proceeds.

The present invention overcomes the shortcomings of the prior art by providing a disposable or long term use beverage container having a cup portion with an aperture therein and a mating cap portion with a mouthpiece extending therefrom with one of the portions having an annular ridge and the other an annular groove for receiving said ridge therein sealing the disposable beverage container from leakage. Additionally the mouthpiece extending from the cap is designed to anatomically fit the user's mouth and provides that the mouthpiece may be nipple shaped for babies and toddlers. Also provided are nubs protruding from opposing sides of the cap that when squeezed breaks the cup cap seal allowing for removal of the cap for selective refilling as desired. The present invention also provides that the disposable beverage container may be manufactured from microwave safe material for those beverages that may require heating.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
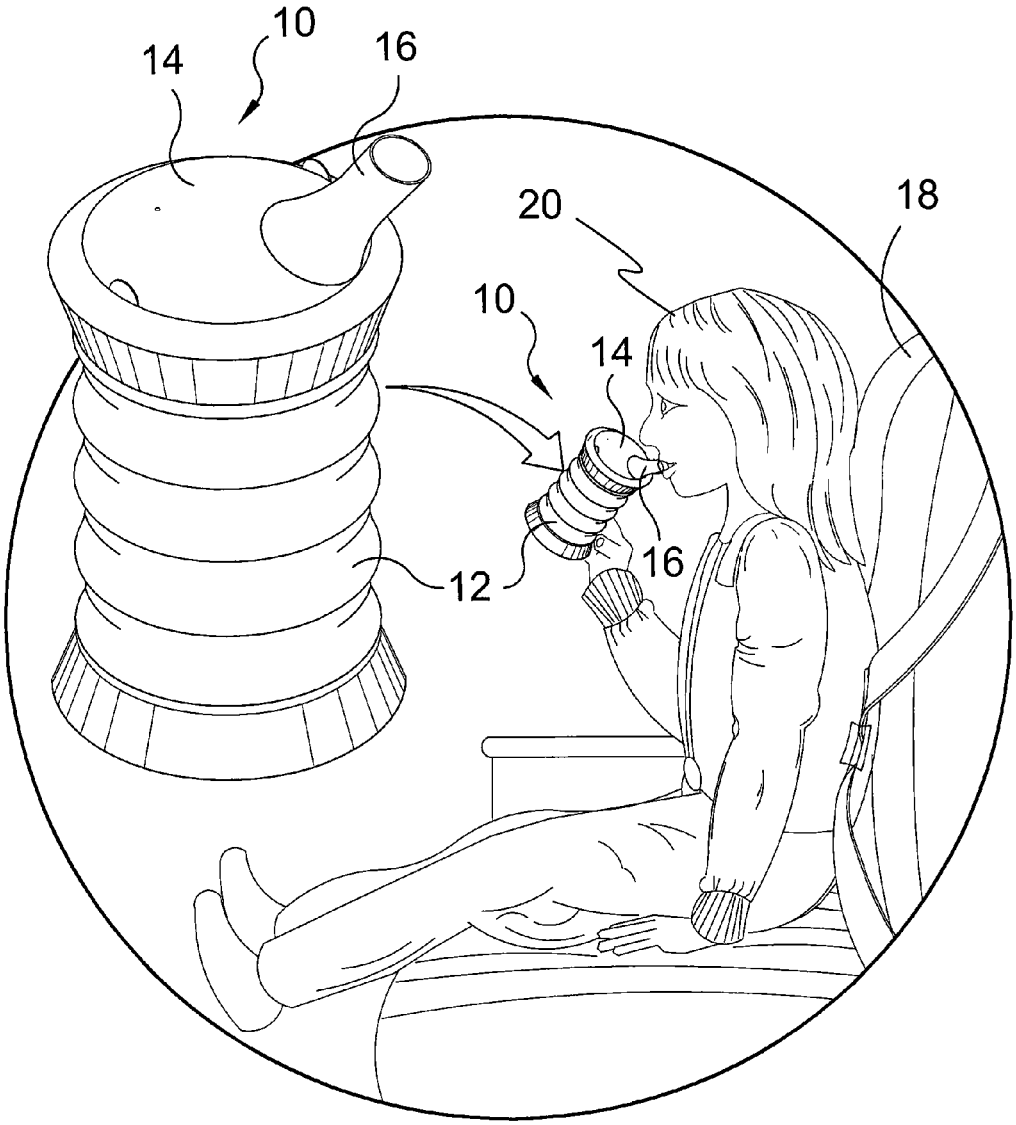
FIG. 1 is an illustrative view of the present invention in use.

Turning now descriptively to the drawings, in which similar reference characters denote similar elements throughout the several views, the figures illustrate the Sip and Go Ergonomic Cup of the present invention. With regard to the reference numerals used, the following numbering is used throughout the various drawing figures.

10 Sip and Go Ergonomic cup of the present invention
12 cup body
14 snap-on cap
16 anatomical mouth piece
18 vehicle
20 user
22 cup holder

24 air hole
26 cap tabs
28 finger grips
30 base of 12
32 sealing ridge
34 sealing groove
36 removable seal
38 rubber hand grips
40 nipple

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention is an ergonomic drinking cup 12 for children having a snap on cap 14 with an anatomical mouthpiece 16 in the shape of a spout. The sip and go cup 10 allows the user 20 a safe and convenient way to travel about the house or for use in a vehicle 18 without spillage. The cup is designed to fit within a conventional vehicle cup holder.

Figure 2:
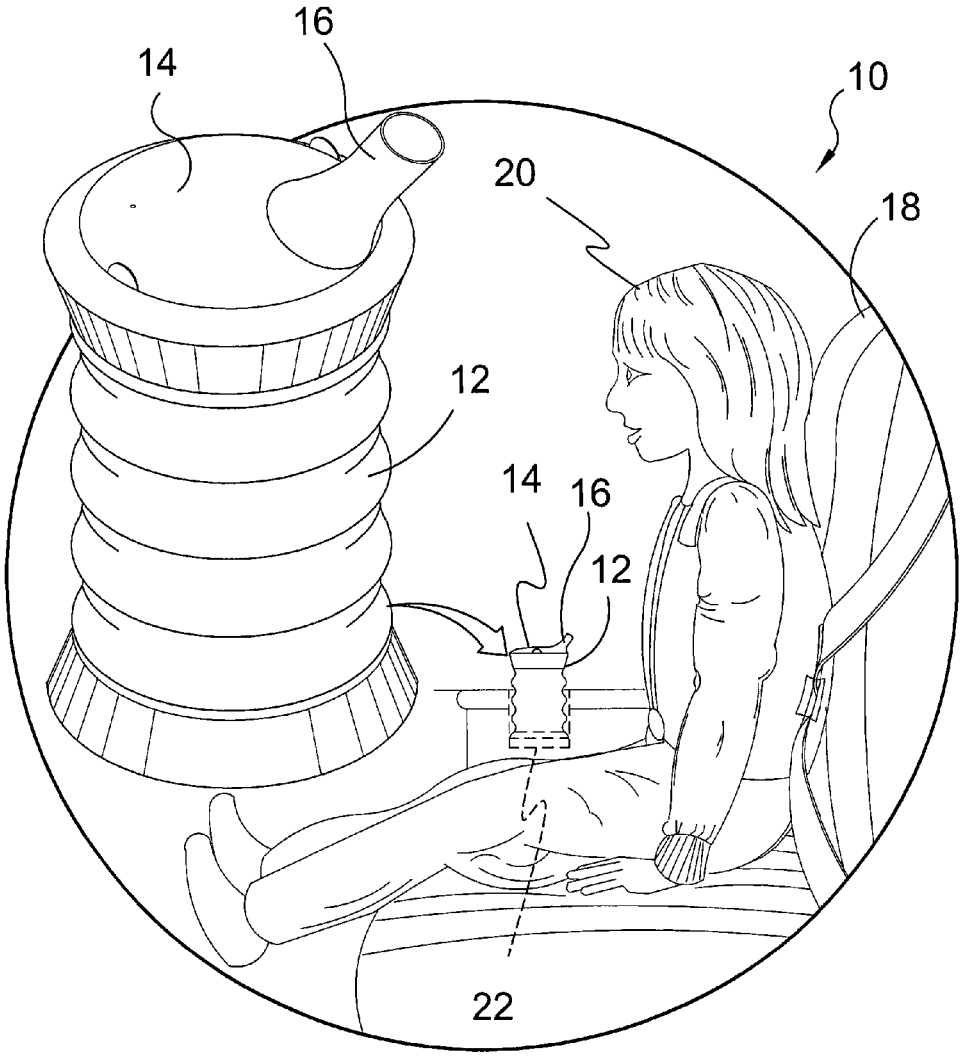
FIG. 2 is an illustrative view of the present invention in use.

FIG. 2 is an illustrative view of the present invention 10 in use. The present invention is an ergonomic drinking cup 12 for children having a snap on cap 14 with an anatomical mouthpiece 16 in the shape of a spout. The sip and go cup 10 allows the user 20 a safe and convenient way to travel about the house or for use in a vehicle 18 without spillage. The cup 12 is designed to fit within a conventional vehicle cup holder 22. The sip and go cup 10 for children is used for commercial consumption and is disposable, but allows the user to refill the cup 12. The present invention provides a childproof cap 14, that also prevents spillage and leaking or dripping from mouthpiece 16. The sip and go cup 10 can be manufactured from a microwave safe material and can also be stored in the refrigerator if contents still remains within and is to be consumed at another time.

Figure 3:
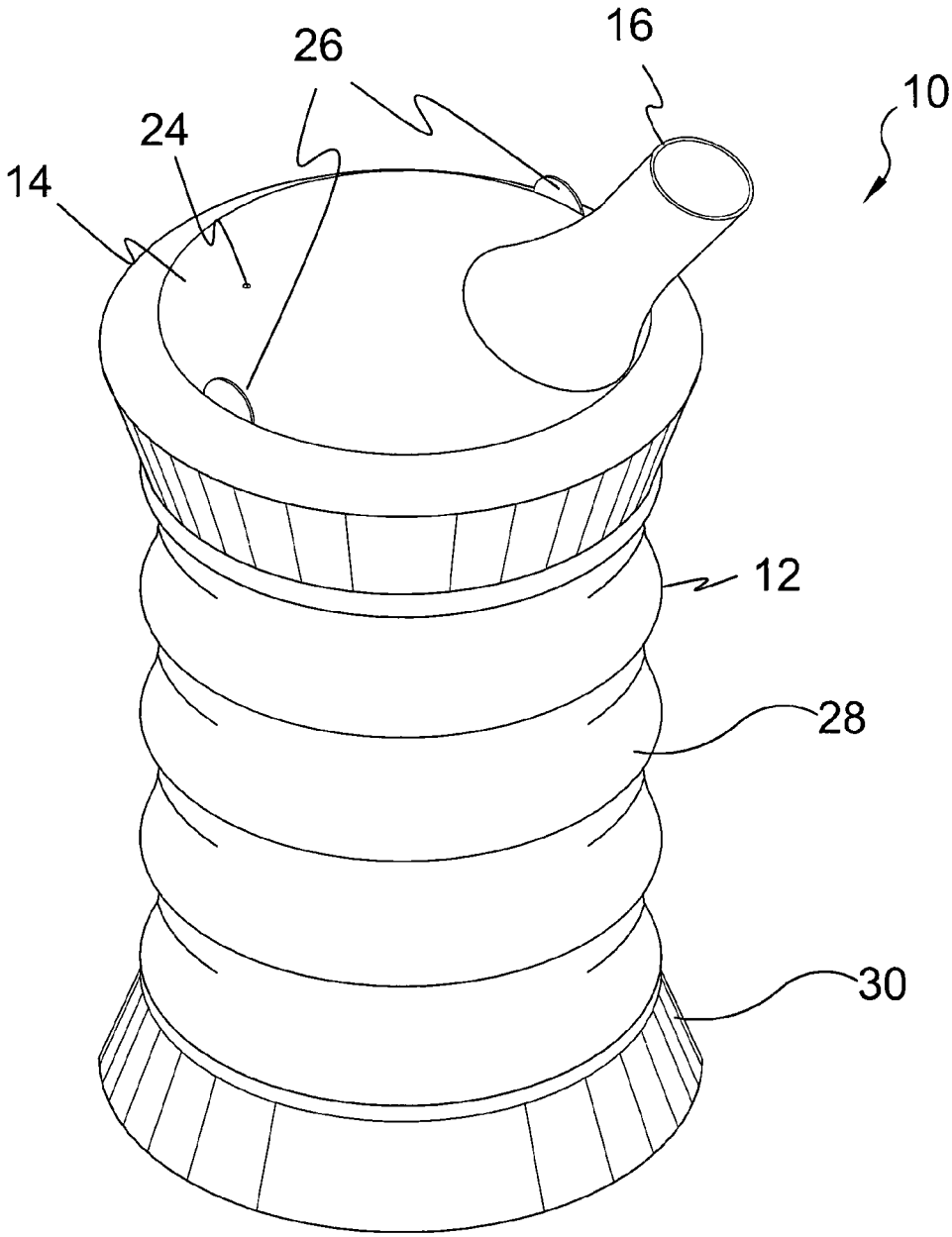
FIG. 3 is a perspective view of the present invention.

FIG. 3 is a perspective view of the present invention 10. The present invention is a drinking sippy cup 10 for children having a snap on cap 14 with an anatomical mouth piece 16 in the shape of a spout. The removable cap 14 comprises an air hole 24 to allow air to flow into the cup 12 as the contents are displaced from the cup 12 by the user. Located between the cap 14 and cup 12 are mating ridge and groove that matingly engage to prevent casual removal of the cap. Also provided are cap tabs 26 positioned on opposing sides whereby pressure applied thereto will break the seal allowing the disposable container to be refilled. The body of the cup 12 has ergonomic finger ridges 28 to provide enhanced grasping thereof by the user. A base 30 enables the user to set the cup in an upright position when not in use.

Figure 4:
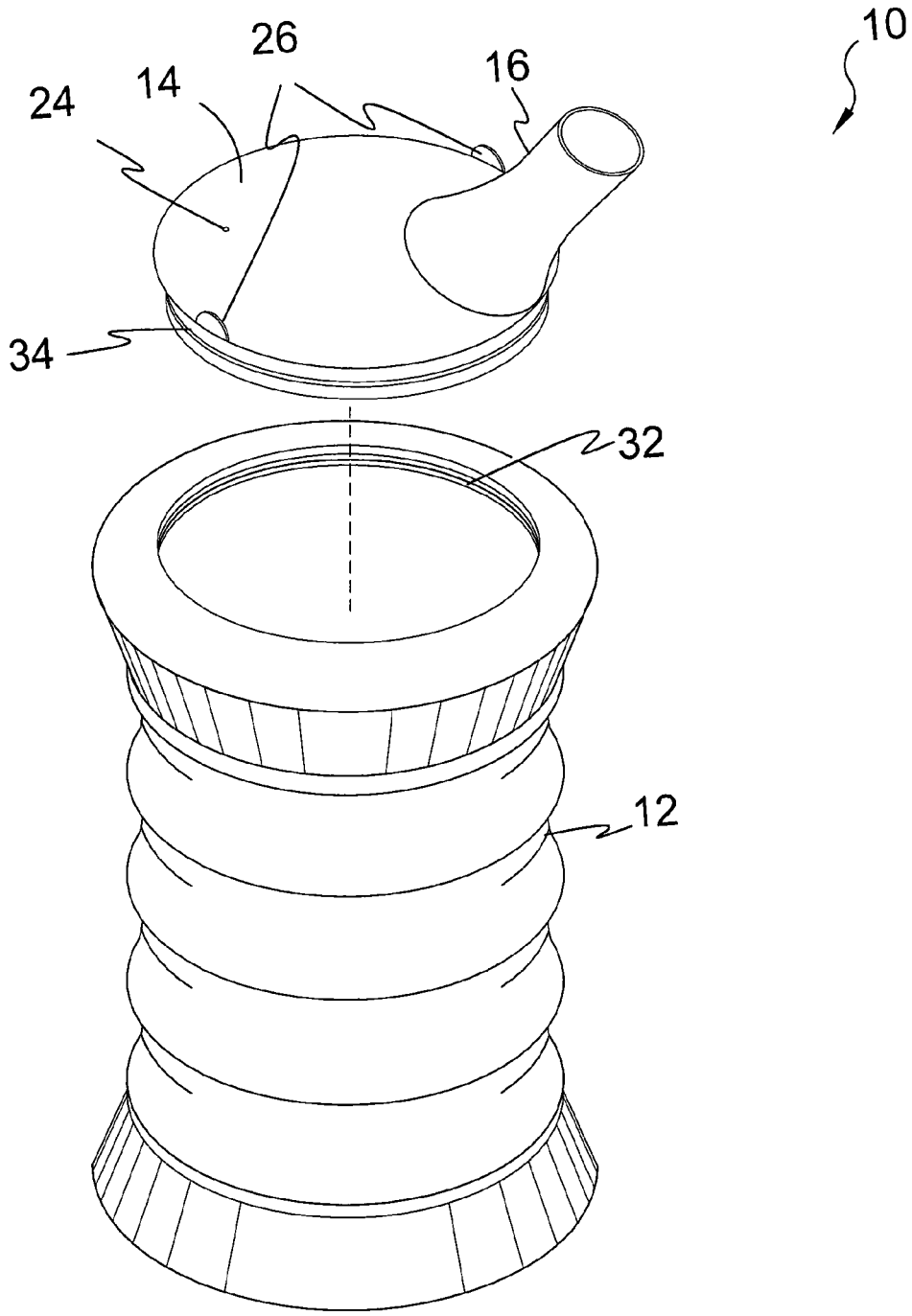
FIG. 4 is an exploded view of the present invention.

FIG. 4 is an exploded view of the present invention 10. Shown is an exploded view of the present invention 10, a drinking cup 12 for children having a removable snap on cap 14 with an anatomical mouthpiece 16 in the shape of a spout. The cap 14 also comprises an air hole 24 to allow air to flow into the cup 12 as the contents are displaced from the cup by the user. Squeeze tabs 26 are provided to assist in the removal of the cap 14. Located within the cup 12 and cap 14 are sealingly engagable ridge 32 and groove 34.

Figure 5:
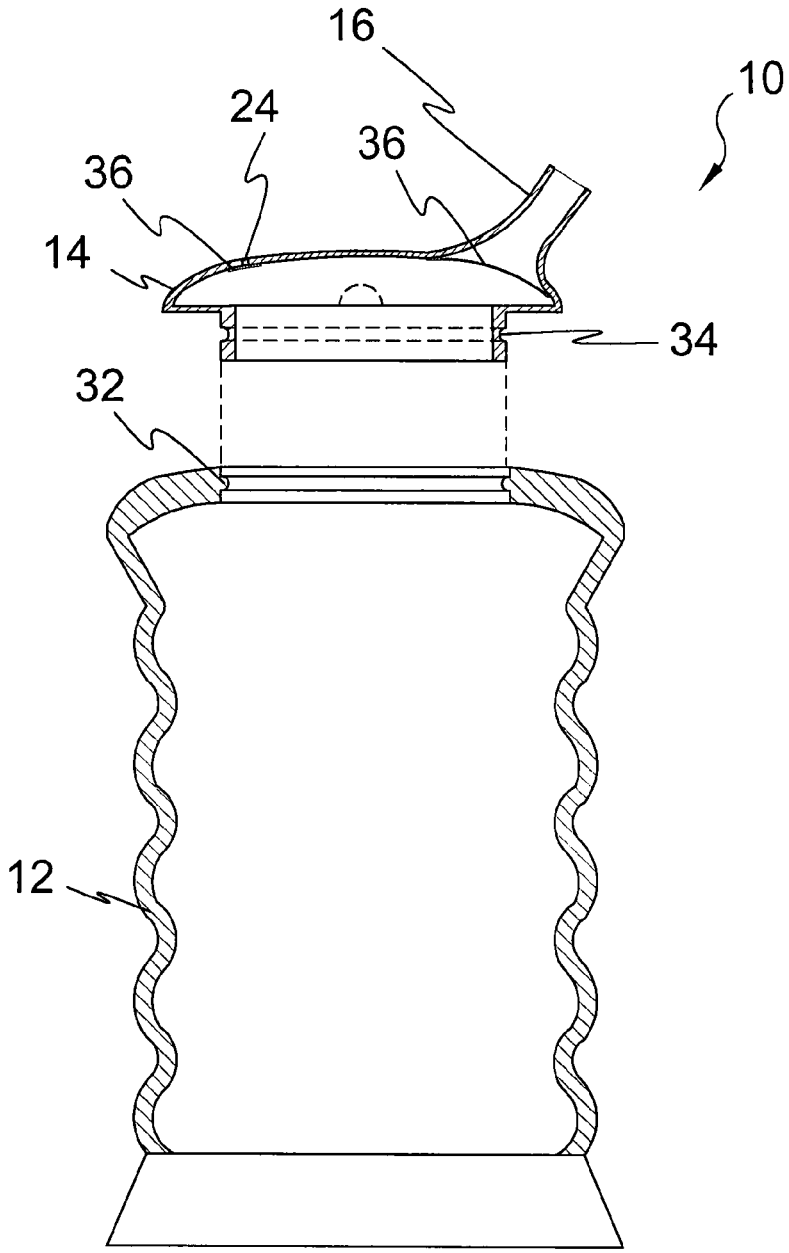
FIG. 5 is a sectional view of the present invention.

FIG. 5 is a sectional view of the present invention 10. The present invention is a disposable beverage container having a cup portion 12 with an aperture therein and a mating cap portion 14 with a mouthpiece 16 extending therefrom. One of the portions has an annular ridge 32 and the other an annular groove 34 for receiving said ridge 32 and therein sealing the disposable beverage container from leakage. The mouthpiece 16 extending from the cap 14 is designed to anatomically fit the user's mouth and additionally provides that the mouthpiece 16 may be nipple shaped for babies and toddlers. Additionally provided are nubs 26 protruding from opposing sides of the cap 14 that when squeezed break the cup cap seal allowing for removal of the cap 14 whereby the disposable container can be refilled as desired. The present invention 10 provides that the disposable beverage container may be manufactured from microwave safe material for those beverages that may require heating.

Figure 6:
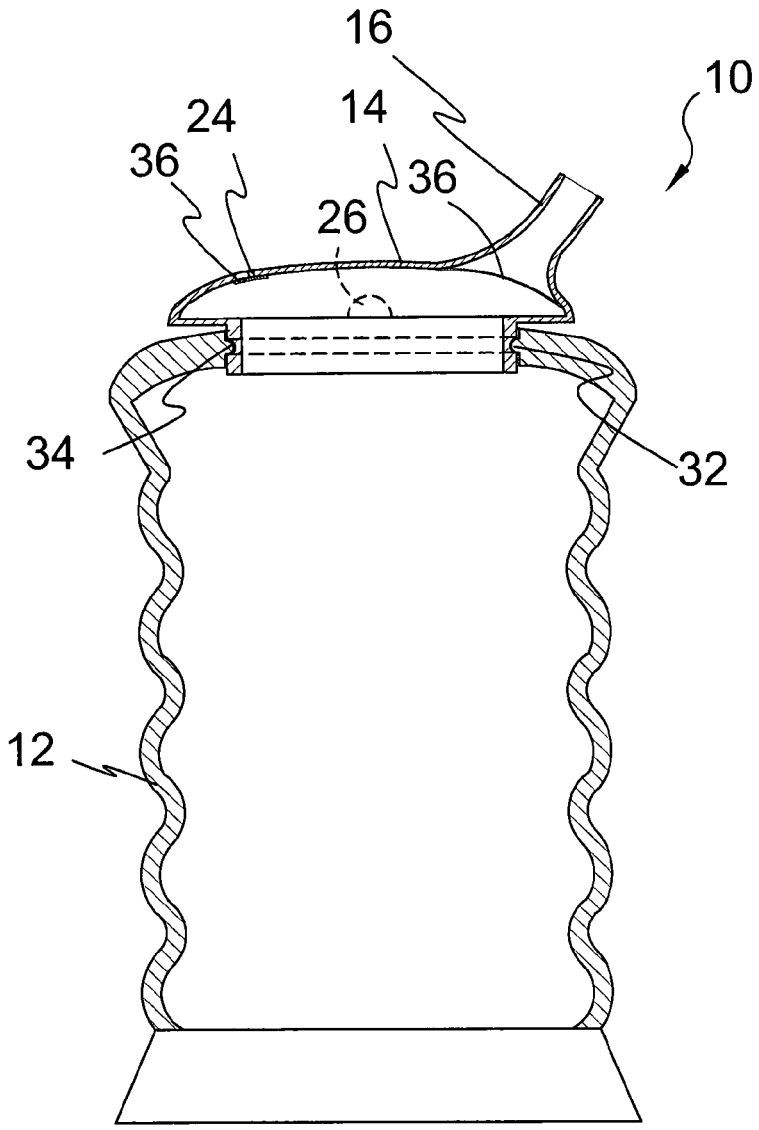
FIG. 6 is a sectional view of the present invention assembled.

FIG. 6 is a sectional view of the present invention 10 assembled. Shown is an assembled sectional view of the present invention 10, a drinking cup 12 for children having a removable snap on cap 14 with an anatomical mouth piece 16 in the shape of a spout. The removable cap 14 also comprises an air hole 24 to allow air to flow into the cup 12 as the contents are displaced from the cup by the user. Squeeze tabs 26 are provided to assist in the opening of the cap 14. Located within the cup 12 are ridge 32 and groove 34 elements securing the cap 14 tightly.

Figure 7:
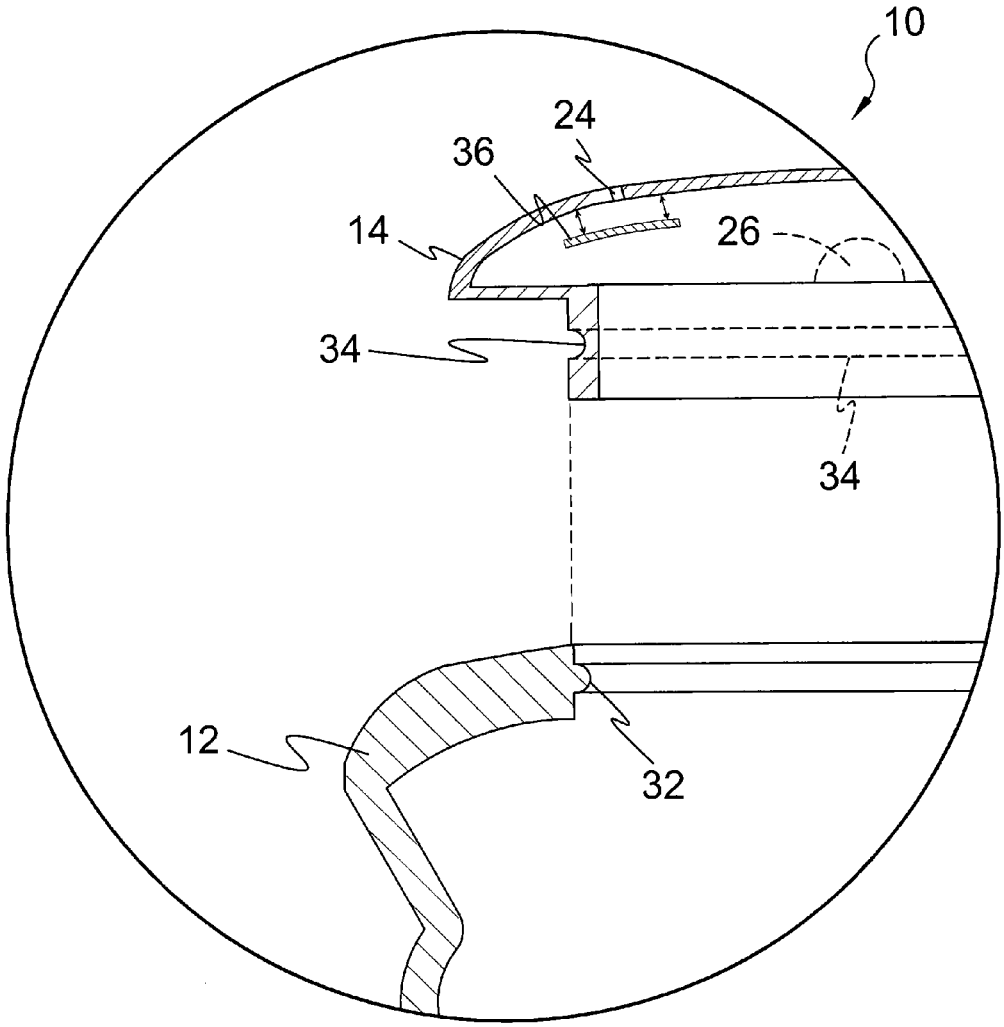
FIG. 7 is a partial detailed sectional view of the present invention.

FIG. 7 is a partial detailed sectional view of the present invention 10. Shown is a sectional view of the cap 14 and the cup 12. Located within the cup 12 is an annular groove 34 that couples to a cap ridge 32 securing the disposable beverage container from leakage. Cap extending nubs 26 are provided to assist in opening the removable cap 14. An air hole 24 having removable seal 36 that when removed allows for air flow during usage.

Figure 8:
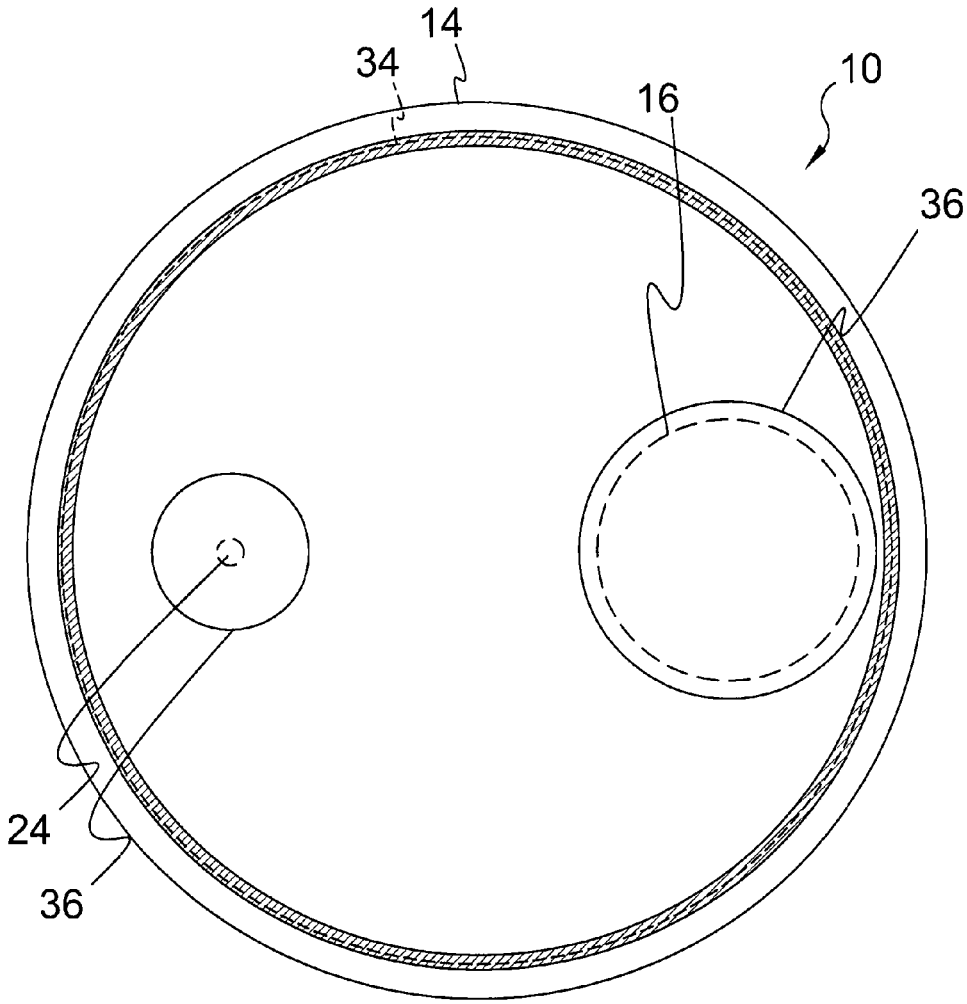
FIG. 8 is a view looking up from under the cup cap.

FIG. 8 is a view looking up from under the cup cap 14. Shown is the snap on cap 14 with an anatomical mouth piece 16 in the shape of a spout with a removable seal 36. The cap also comprises an air hole 24 also having a removable seal that when removed allows air to flow into the cup as the contents are displaced from the cup by the user through the anatomical mouth piece 16. Squeeze tabs are provided to assist in the reopening of the cap.

Figure 9:
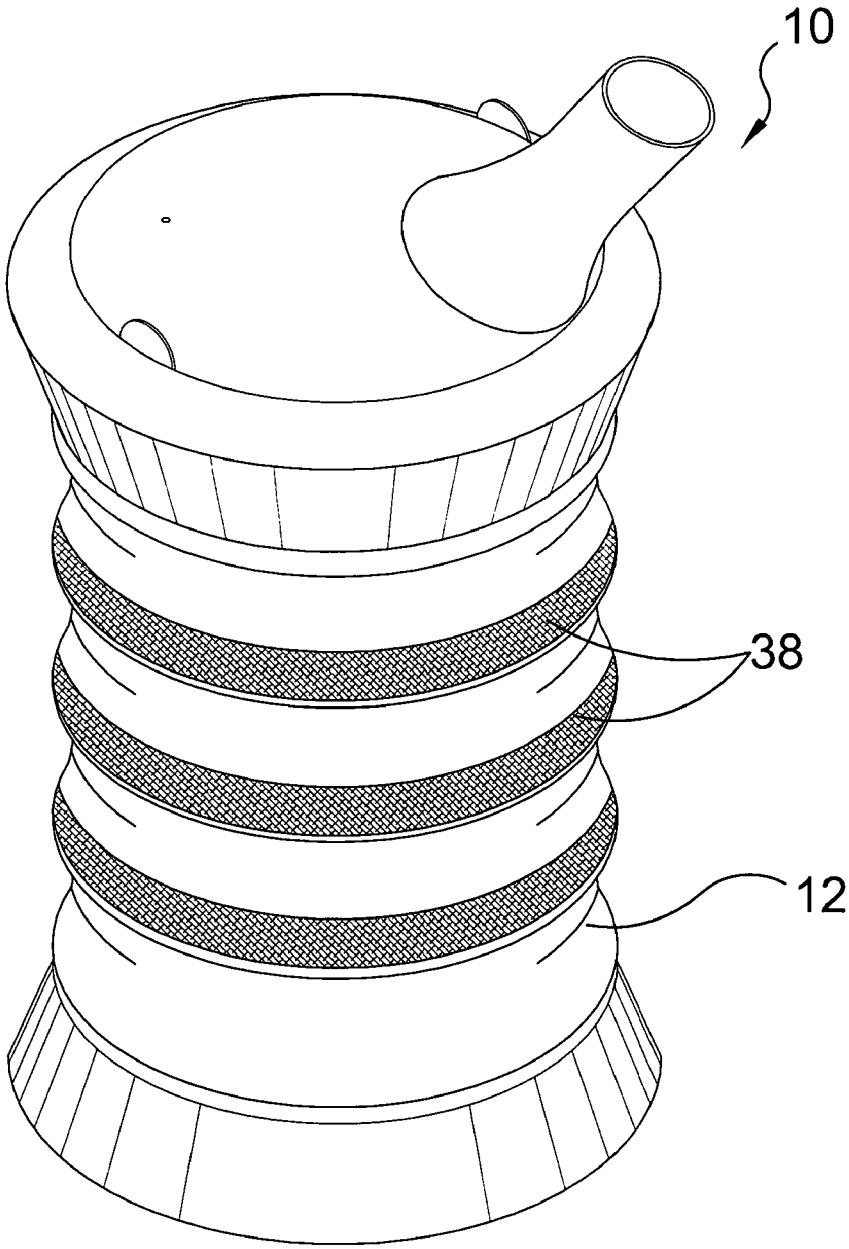
FIG. 9 is an alternate view of the present invention.

FIG. 9 is an alternate view of the present invention 10. Shown is an alternate view of the present invention 10 having rubber hand grips 38 located on the external housing of the cup 12 as an additional element.

Figure 10:
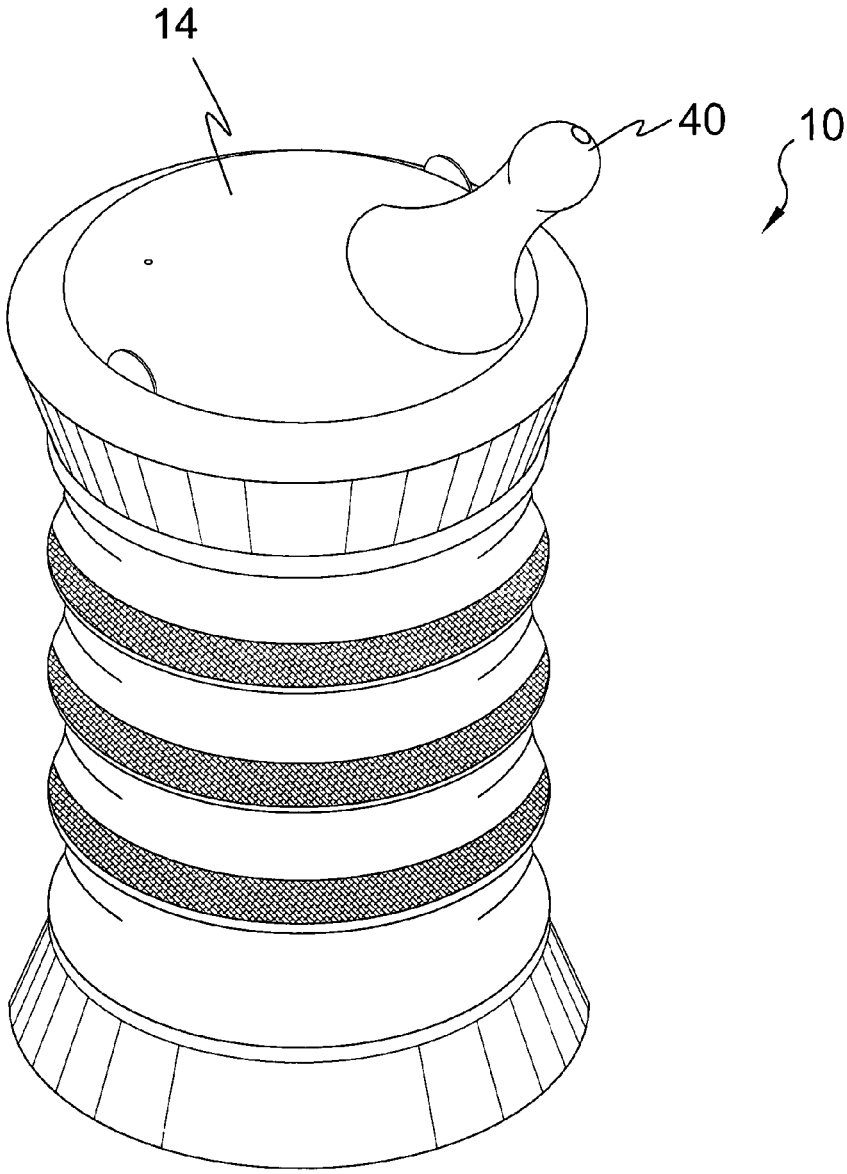
FIG. 10 is another alternate view of the present invention.

FIG. 10 is another alternate view of the present invention 10. Shown is an alternate view of the present invention having a rubber nipple mouth piece 40 located on the external housing of the cap 14 as an additional element.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An ergonomic beverage container to promote proper lip closure and sucking during the oral development of a child, said container comprising:

a) a cup body having an sidewall terminating at an upper end, an end wall extending inwardly from said upper end of said sidewall terminating in a circular mouth, said circular mouth having a vertically disposed edge extending downwardly from an upper surface of said end wall;

b) a snap-on cap to secure onto said cup body;

c) a child proof means to secure said cap to said cup;

d) said cap having an arcuate upper surface terminating in an outermost edge, said cap having a planar lower surface inwardly extending from said outermost edge and terminating in a downwardly extending cylindrical wall, said cylindrical wall being disposed radially inwardly from said outermost edge;

e) said means further comprises a sealing protrusion disposed on said vertically disposed edge below said upper surface of said end wall;

f) said means further comprises a sealing groove in said vertical wall; and g) said sealing protrusion snaps into said sealing groove to form a hermetic seal to prevent fluid secured therein from leaking from the bonded area between the cup and the cap positioning said planar lower surface of said cap over said end wall.

2. The ergonomic beverage container recited in claim 1, wherein said bond between said cap and said cup is compromised for removal by a pair of squeeze tabs.

3. The ergonomic beverage container recited in claim 2, wherein said squeeze tabs must be pressed simultaneously thereby limiting the ability of a child to remove said cap.

4. The ergonomic beverage container recited in claim 1, wherein said anatomical mouth piece is formed to enhance the promotion of proper lip closure and sucking.

5. The ergonomic beverage container recited in claim 1, wherein said cap further includes an air hole to provide for the smooth passage of fluid therethrough.

6. The ergonomic beverage container recited in claim 5, wherein said air hole is pin sized to promote stronger sucking.

7. The ergonomic beverage container recited in claim 1, wherein said cup body comprises a plurality of finger grips.

8. The ergonomic beverage container recited in claim 7, wherein said finger grips are rubberized.

9. The ergonomic beverage container recited in claim 8, wherein said mouth piece is a nipple.

10. The ergonomic beverage container recited in claim 1, wherein said cap includes a removable seal over said mouth piece and said air hole on the underside of said cap to provide fluid retention therein prior to usage thereof.

11. The ergonomic beverage container recited in claim 1, wherein said container is disposable.

12. The ergonomic beverage container recited in claim 1, wherein said container is reusable.

13. The ergonomic beverage container recited in claim 1, wherein said container and cap are fabricated of microwavable material.

14. The ergonomic beverage container recited in claim 1, said end wall having a thickness defined by said upper surface and an opposed lower surface, said upper and lower surfaces joined by said vertically disposed edge at said circular mouth, and said planar lower surface of said cap extending outwardly over said upper surface.

15. The ergonomic beverage container recited in claim 1, said upper surface of said cap being spaced from said planar lower surface defining a void there between.

* * * * *